United States Patent [19]

Lee

[11] Patent Number: 4,939,961

[45] Date of Patent: Jul. 10, 1990

[54] REVERSIBLE WRENCH

[76] Inventor: Clark J. Lee, 429-6 Chung Cheng Rd., Fu Liao Li, Tsao Tun Town, Nantou Hsien, Taiwan

[21] Appl. No.: 330,802

[22] Filed: Mar. 30, 1989

Related U.S. Application Data

[63] Continuation-in-part of Ser. No. 184,104, Apr. 20, 1988, abandoned.

[51] Int. Cl.[5] ..... B25B 13/46

[52] U.S. Cl. ..... 81/60; 81/58.3

[58] Field of Search ..... 81/58.3, 59.1–63.2

[56] References Cited

U.S. PATENT DOCUMENTS

| | | | |
|---|---|---|---|
| Re. 28,037 | 6/1974 | LaPointe | 81/61 |
| 145,399 | 12/1873 | Colbert . | |
| 249,003 | 11/1881 | Cherry | 81/58.3 |
| 1,321,005 | 11/1919 | Bowman . | |
| 1,628,467 | 5/1927 | Mandl . | |
| 1,644,079 | 10/1927 | O'Neill . | |
| 1,873,472 | 8/1932 | Pfauser . | |
| 2,667,801 | 2/1954 | Eaves | 81/58.3 |
| 3,466,953 | 9/1969 | Gegg | 81/58.3 |
| 3,640,158 | 2/1972 | Myers | 81/5.83 |
| 4,408,504 | 10/1983 | Dobosh | 81/59.1 |
| 4,475,420 | 10/1984 | Atkinson et al. | 81/58.3 |
| 4,603,606 | 8/1986 | Headen | 81/59.1 |

FOREIGN PATENT DOCUMENTS

| | | | |
|---|---|---|---|
| 3229016 | 2/1984 | Fed. Rep. of Germany . | |
| 561125 | 5/1944 | United Kingdom | 81/58.3 |

*Primary Examiner*—James G. Smith

*Attorney, Agent, or Firm*—Bacon & Thomas

[57] ABSTRACT

The present invention provides a reversible wrench which comprises a first gear face disc having a single side profile teeth on one of its flat sides and a square central hole, and rotatably mounted in one end of the wrench body; a second gear face disc having a symmetrical single side profile teeth on one of its flat sides and a central hole which is concentrically disposed in the first disc and meshed with the first disc by the depressing of an undulated spring washer or compression spring which is axially bounded between the discs and the wrench body; a driving stud which is slidably received through the square hole of the first disc, the hole of the second disc, and the spring washer, with at least one end thereof projecting from one of the opposite sides of the wrench body; in which the second gear face disc being non-rotatably connected to the wrench body.

7 Claims, 9 Drawing Sheets

REVERSIBLE WRENCH

This application is a Continuation-in-Part of Ser. No. 07/184,104 filed on Apr. 20, 1988 in the name of Clark J. Lee. Now Abandoned.

BACKGROUND OF THE INVENTION

The present invention relates to a reversible wrench and more particularly to a feature for reversible wrench having no conventional ratcher wheel.

Known reversible wrenches normally comprise a handle, a coupling member rotatably mounted in one end of the handle having a portion of angular cross section projecting from one side thereof on an axis perpendicular to the handle, and ratchet means for connecting the coupling member to rotate with the handle around said axis, in which said ratchet means generally comprises a spur gear and a pawl having spaced teeth which is mounted by a pin for pivotal movement to provide the selective locking between the pawl and the spur gear. Reversible ratchet wrenches disclosed in U.S. Pat. Nos. 4,336,728; 4,485,700 and 4,589,307 have constructions similar to the ratchet wrenches discussed above.

U.S. Pat. No. 3,564,954 discloses a socket wrench which comprises a driving square projecting from both opposite sides of the wrench, and only a single pawl. Since the two sides of the wrench are of identical construction, the rotation of the ratchet wheel can be changed from clockwise to counter-clockwise or vise versa, as used by the operator by merely inverting the wrench.

The reversible wrenches prior to the present invention are complicated in construction and assembly, and thus add to the cost of the wrenches. Furthermore, the locking between the ratchet wheel and the pawl is accomplished by maintaining only one or two teeth of the ratchet wheel in engagement with the pawl, which may not have sufficient strength in a high torque application.

SUMMARY OF THE INVENTION

An object of the present invention is to provide a reversible wrench which does not have the above mentioned drawbacks of conventional reversible ratchet wrenchs.

Another object of the present invention is to provide a reversible wrench which does not contain a conventional ratchet wheel.

In carrying out the above object, the reversible wrench according to the present invention comprises a first gear face disc having single side profile teeth on one of its flat sides and a square hole through the middle of it which is rotatably mounted in one end of the wrench body; a second gear face disc having the symmetrical single side profile teeth on one of its flat sides and a hole through the middle of it which is concentrically disposed on the first disc and meshed with the first disc by the depressing of an undulated spring washer which is axially bounded by one of the discs and the wrench body; a driving square which is slidably received by the square hole of the first disc, the hole of the second disc, and the spring washer with at least one end thereof projecting from one of the opposite side of the wrench body; in which the second gear face disc is further non-rotatably connected to the wrench body.

In addition to the conventional socket retaining balls located at each end of the driving square, the driving square of the present invention preferably further comprises a central retaining ball or shaft which is adapted to engage an axial groove or axial recesses in one of the side walls of the square hole of said first gear face disc and the hole of said second gear face disc for slidably retaining itself in said holes.

The undulated spring washer of this invention may be replaced by a compression coil spring which has a central diameter large enough for the driving square to penetrate therethrough.

The driving square as well as the square hole of said first gear face disc of this invention may alternatively have any shape of angular cross section as long as they are conformable to each other.

Because the teeth of the gear face discs each have a single side profile, the first gear face disc as well as the driving square will only be driven by the second gear face disc which is non-rotatably connected to the wrench body in a single direction as the wrench is rotated. Since the mesh between the two gear face discs is effected by the depressing of the spring washer, the second gear face disc will slide on the first gear face disc as the wrench is rotated in the opposite direction; i.e., the wrench is reversed without driving the driving square.

Since the two sides of the wrench have the identical function, the rotation of the gear face discs can be changed from clockwise to counter-clockwise or vice versa, by the operator merely pushing the driving square to project from the opposite side of the wrench.

In accordance with one feature of the invention, the second gear face disc has axial spline teeth on its periphery which engage corresponding axial spline teeth on the wrench body to non-rotatably connect the second gear face disc to the wrench body.

In accordance with another feature of the invention, the second gear face disc has a plurality of spaced axial ribs on its rim, and is non-rotatably connected to the wrench body by sliding said ribs in the corresponding slots located inside the wrench body.

In accordance with another feature of the invention, the second gear face disc has a plurality of upright posts on the smooth side thereof, and is non-rotatably connected to the wrench body by coupling said upright posts into the corresponding bores located inside the wrench body.

In one of the alternative embodiments of the invention, the driving square may be fixedly mounted in the square hole of said first gear face disc with both ends thereof projecting from the opposite sides of the wrench. It is apparent that this alternative embodiment will have the same reversible function as the wrench discussed above.

The objects, features, and advantages of the present invention are readily apparent from the following detailed description of the preferred embodiments when taken in connection with accompanying drawings.

BRIEF DESCRIPTION OF THE DRAWINGS

In the various views, like reference numbers refer to like elements.

DETAILED DESCRIPTION OF THE PREFERRED EMBODIMENTS

Figure 1:
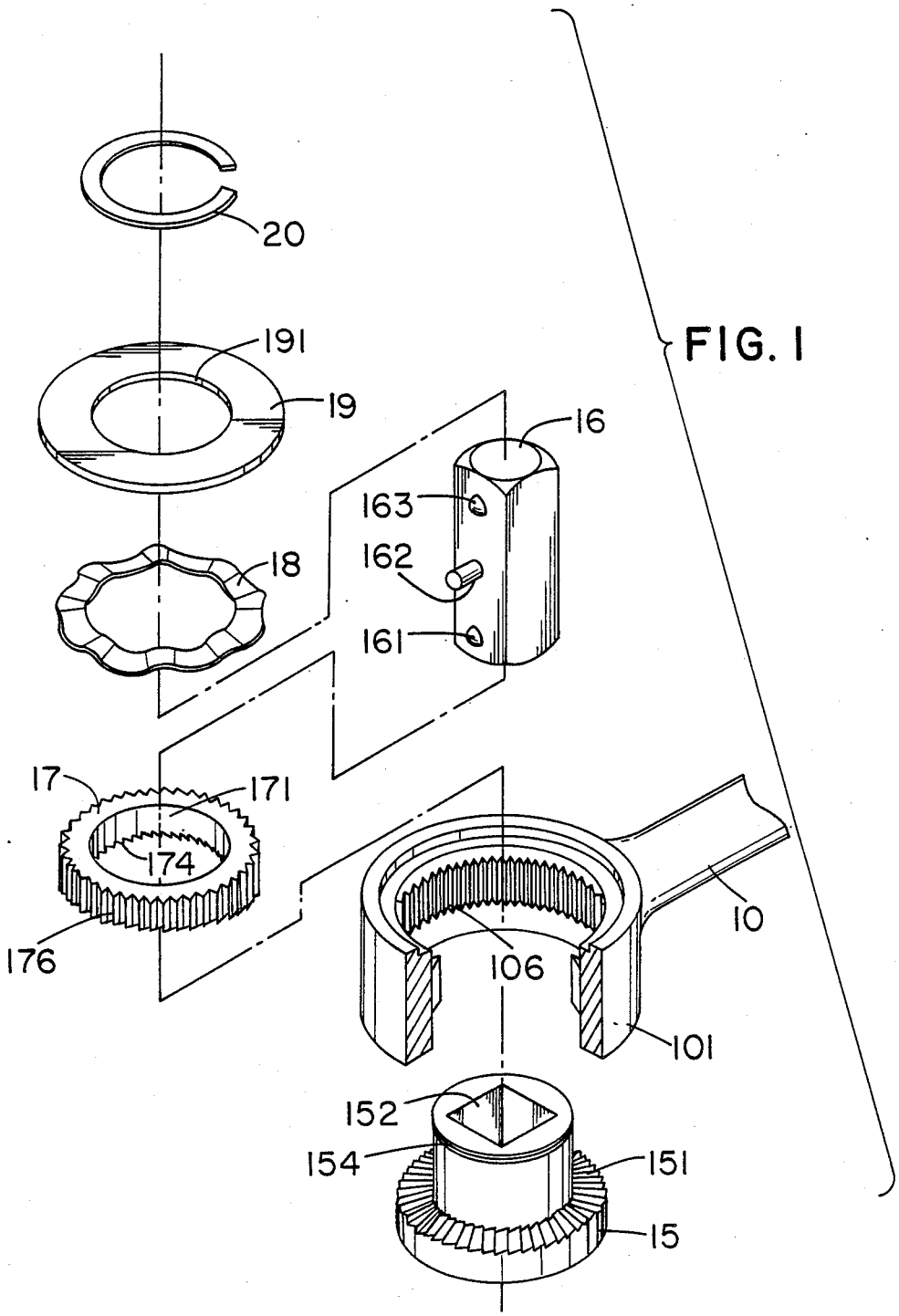
FIG. 1 is an exploded perspective view that illustrates the consturction of a wrench according to the prevention invention.
Figure 2:
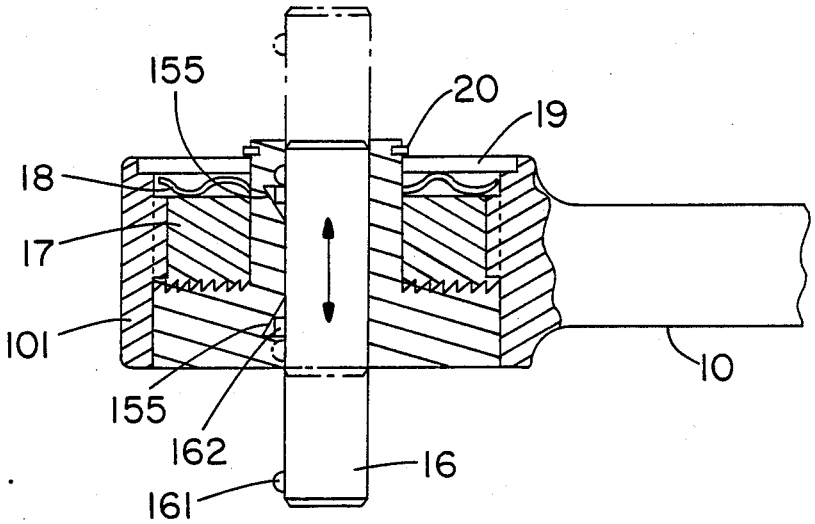
FIG. 2 is a longitudinal, vertical sectional view of the wrench in FIG. 1.

The present invention will be described in greater detail with reference to the accompanying drawings wherein several preferred embodiments of the present invention are set forth. One embodiment of the present invention is shown in FIGS. 1 and 2 of the drawings. In this embodiment, a reversible wrench constructed in accordance with the present invention generally comprises a wrench body including a head and a handle 10 extending therefrom, said head further providing a round driver housing 101. Driver housing 101 has an opening perpendicular to the handle 10. Inside the driver housing 101, there are axial spline teeth 106 around the side wall.

A first gear face disc 15 which has single profile teeth 151 on one of its flat sides and a square hole 152 through its extended middle is rotatably received in the drive housing 101 with its smooth side adjacent to one side of the drive housing 101. A second gear face disc 17 which has single side profile teeth 174 symmetric to the teeth 151 on one of its flat sides and a circular hole 171 through its middle is placed over the enlarged middle of gear face disc 15 in the driver housing 101 and meshed with the first gear face disc 15 by sliding the axial spline teeth 176 into mesh with the corresponding axial spline teeth 106.

An undulated spring washer 18 which has an outer diameter less than the opening of the drive housing 101 but large than the diameter of the hole 171 is bounded between a cover plate 19 and the second gear face disc 17. The cover plate 19 which has a circular hole 191 through its middle is fixed on the opening of the driver housing 101 by C-shaped snap ring 20 which snaps into groove 154 formed in the enlarged middle of gear face disc 15.

The undulated spring washer 18 as shown in FIG. 2 has an elasticity high enough to depress the second gear face disc 17 to mesh with the first gear face disc 15, more importantly, the in situ undulated spring washer 18 is allowed to be further compressed as the teeth 174 of the second gear face disc 17 slide on the teeth 151 of the first gear face 15. This undulated spring washer 18 may be replaced by a compression coil spring.

A driving a stud 16 which has a square cross section corresponding to the square hole 152 of the first gear face disc 15 is inserted into the hole of the undulated spring washer 18, the hole 171 of the second gear face disc 17, and the square hole 152 of the first gear face disc 15 before cover plate 19 is fixed on the opening of the driver housing 101. A larger retaining ball or spring biased shaft 162 at the longitudinal center of the driving stud 16 is adapted to engage one of the vertical recesses 155 on one of the side walls of the square hole 152. Recesses 155 are triangularly shaped in vertical cross-section to assist the entry of shaft 162. The inclined wall portion assists such entry, while the generally horizontal wall prevents the stud 16 from moving too far. Retaining balls 161, 163 located near each end of the driving stud are mainly for retaining a socket thereon.

When the handle 10 of the wrench as shown in FIG. 2 is rotated in a clockwise direction by an operator, the first gear face disc 15 will be driven to rotate clockwise by the second gear face disc 17 which is non-rotatably connected to the wrench body because the mesh between teeth 151 and teeth 174 is effective in this direction. When the handle 10 is rotated in a counterclockwise direction with the driving stud 16 fixed non-rotatably, the second gear face face disc 17 will depress the undulated spring washer 18 and slide on the first gear face disc 15. Therefore, a socket retained by the retaining ball 161 can be used to reversibly tighen a right-handed thread screw. Consequently, a socket retained by the retaining ball 163 can be used to reversibly loosen a right-handed thread screw.

Figure 4:
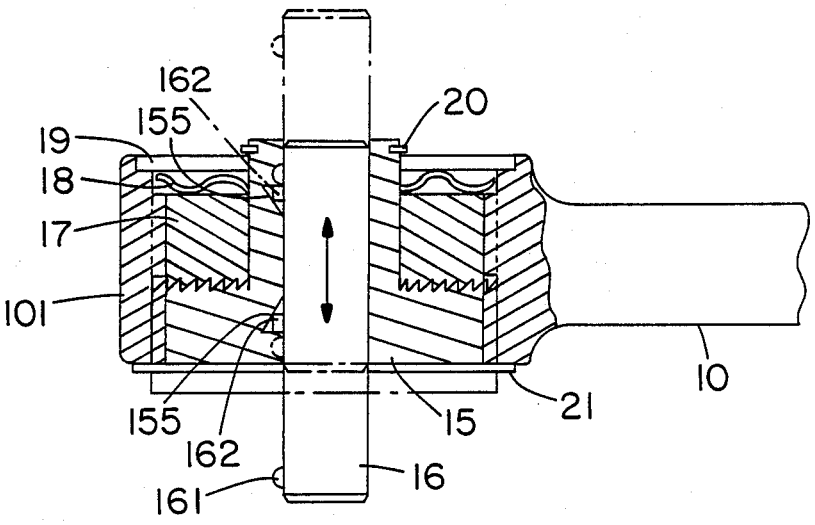
FIG. 4 is a longitudinal, vertical sectional view of the wrench in FIG. 3.
Figure 3:
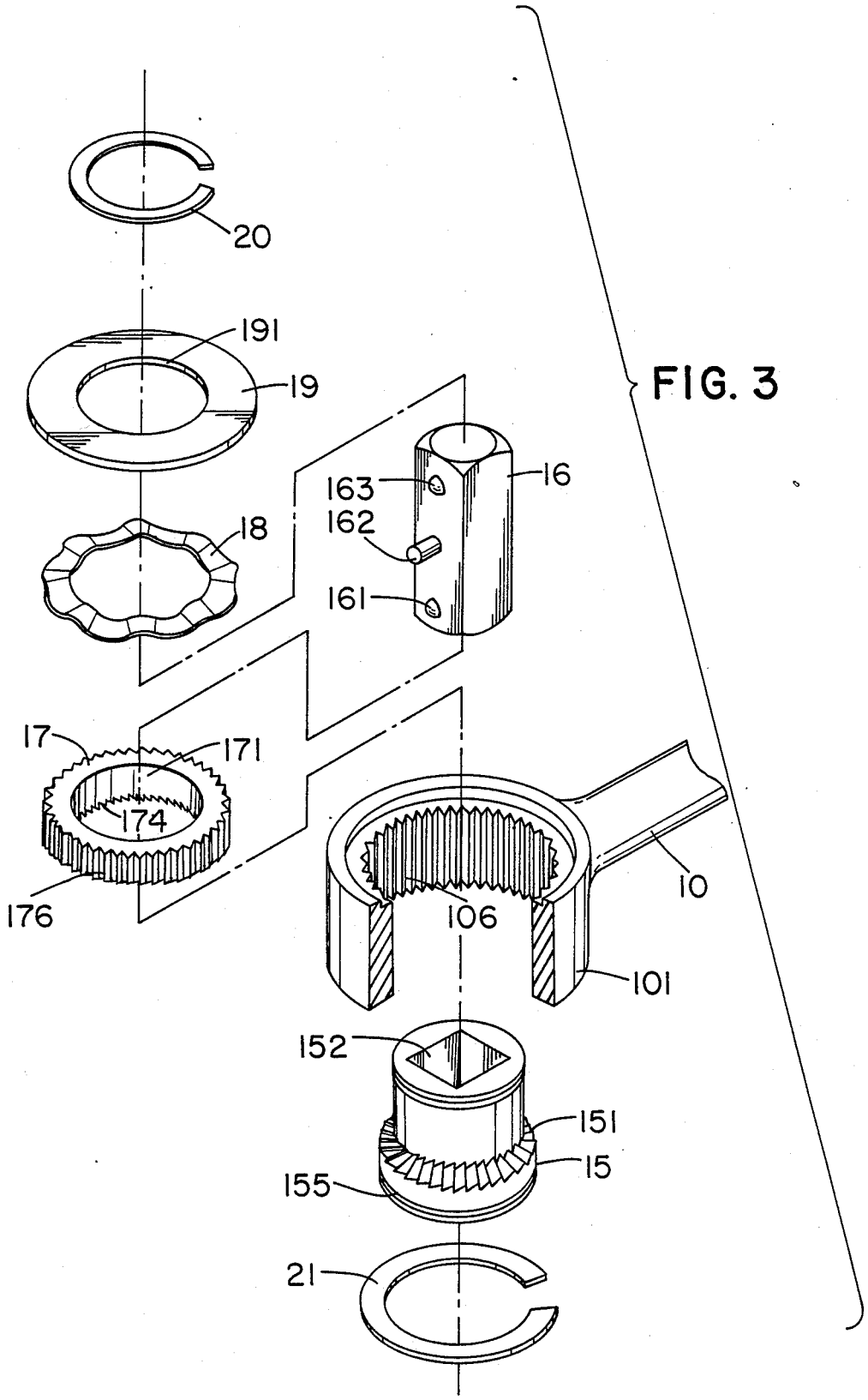
FIG. 3 is an exploded perspective view that illustrates the construction of a wrench according to a second embodiment of the present invention.

A second embodiment is shown in FIGS. 3 and 4 and is similar to that of FIGS. 1 and 2, except that spline teeth 106 extend the entire length of housing 101 and second C-shaped snap ring 21 is used to hold gear face disc 15 in housing 101. Snap ring 21 enages groove 155 and bears against a face of driver housing 101 as shown in FIG. 2.

Figure 5:
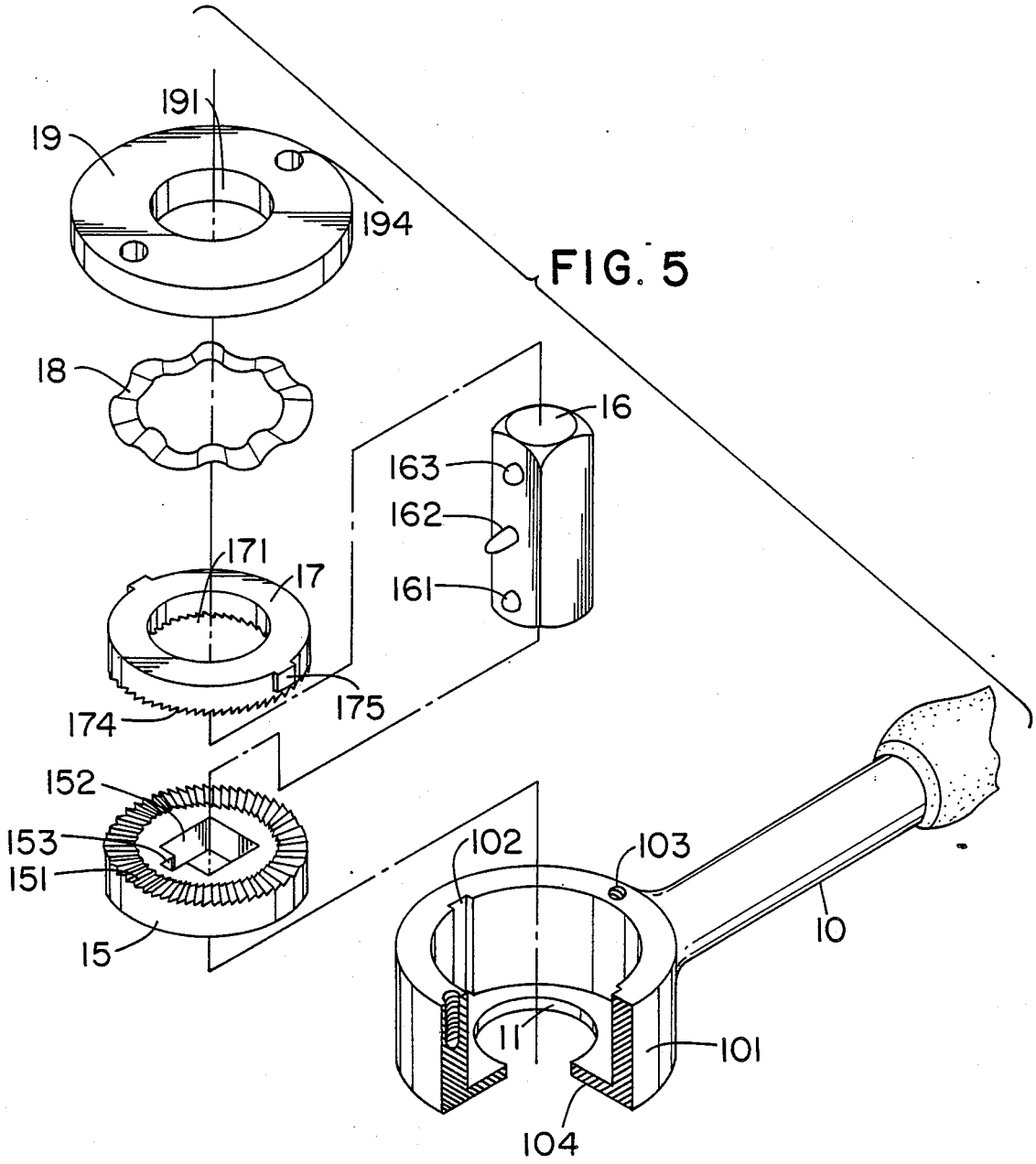
FIG. 5 is an exploded perspective view that illustrates the construction of a wrench according to a third embodiment of the present invention.
Figure 6:
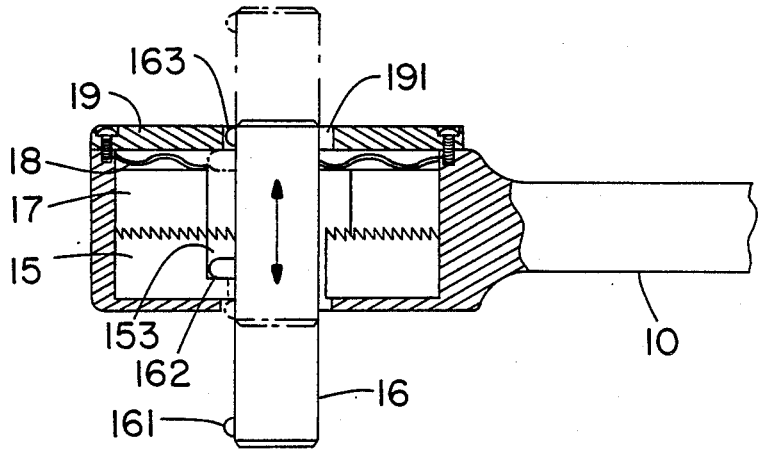
FIG. 6 is a longitudinal vertical section view of the wrench in FIG. 5.

Another alternative embodiment is shown in FIGS. 5 and 6. In this embodiment, the driver housing 101 has a bottom plate 104 which has a circular hole 11 through its middle. Inside the driver housing 101, there are two upright slots 102 on the side wall and opposite to each other.

The first gear face disc 15 has single profile teeth 151 on one of its flat sides and a square hole 152 through its middle and is rotatably received on the bottom plate 104 of the driver housing 101 with its smooth side adjacent to the bottom plate 104. The second gear face disc 17 again has single side profile teeth 174 symmetric to the teeth 151 on one of its flat sides and a circular hole 171 through its middle and is placed in the driver housing 101 and meshed with the first gear face disc 15 by sliding the ribs 175 in the corresponding slots 102.

Undulated spring washer 18 has an outer diameter less than the opening of the driver housing 101, but larger than the diameter of the hole 171 is placed between a cover plate 19 and the second gear face disc 17. The cover plate 19 which has a circular hole 191 through its middle is fixed on the opening of the driver housing 101 by fastening screws through holes 194 into threaded bores 103 at the top of the housing 101.

The undulated spring washer 18 as shown in FIG. 6 has an elasticity high enough to depress the second gear face disc 17 to mesh with the first gear face disc 15, more importantly, the in situ undulated spring washer 18 is allowed to be further compressed as the teeth 174 of the second gear face disc 17 is sliding on the teeth 151 of the first gear face 15.

The driving stud 16 has a square cross section corresponding to the square hole 152 of the first gear face disc 1 is inserted into the hole of the undulated spring washer 18, the hole 171 of the second gear face disc 17, and the square hole 152 of the first gear face disc 15 before the cover plate 19 is fixed on the opening of the driver housing 101. A larger retaining ball 162 at the longitudinal center of the driving stud 16 is adapted to engage a vertical groove 153 on one of the side walls of the square hole 152 and the hole 171 of the second gear face disc. Retaining balls 161, 163 located near each end of the driving stud are mainly for retaining a socket thereon.

As shown in FIG. 6, the vertical groove 153 of the first gear face disc only extends from the gear face side to about ⅔ of the thickness of the first gear face disc in order to prevent the driving stud 16 received therein from detaching as the driving stud is pressed downward. Also the circular hole 191 which has a diameter less than the total thickness of the retaining ball 162 and the driving stud 16 will have the same blocking function as the driving stud is pressed upward.

Figure 8:
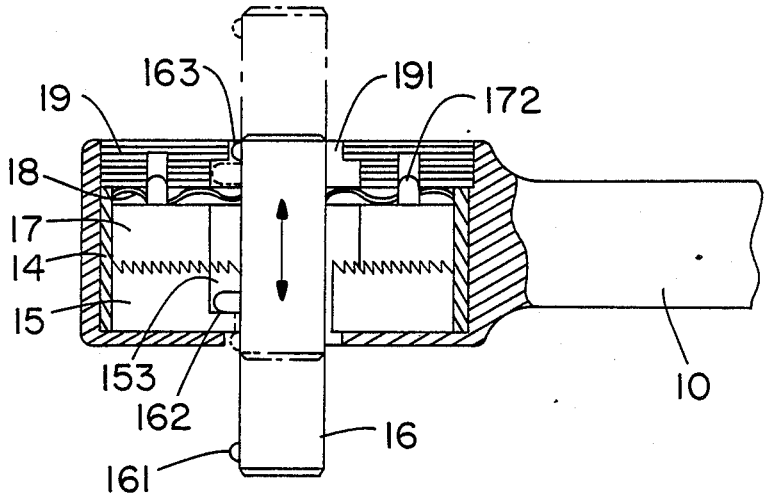
FIG. 8 is a longitudinal vertical section view of the wrench in FIG. 7.
Figure 7:
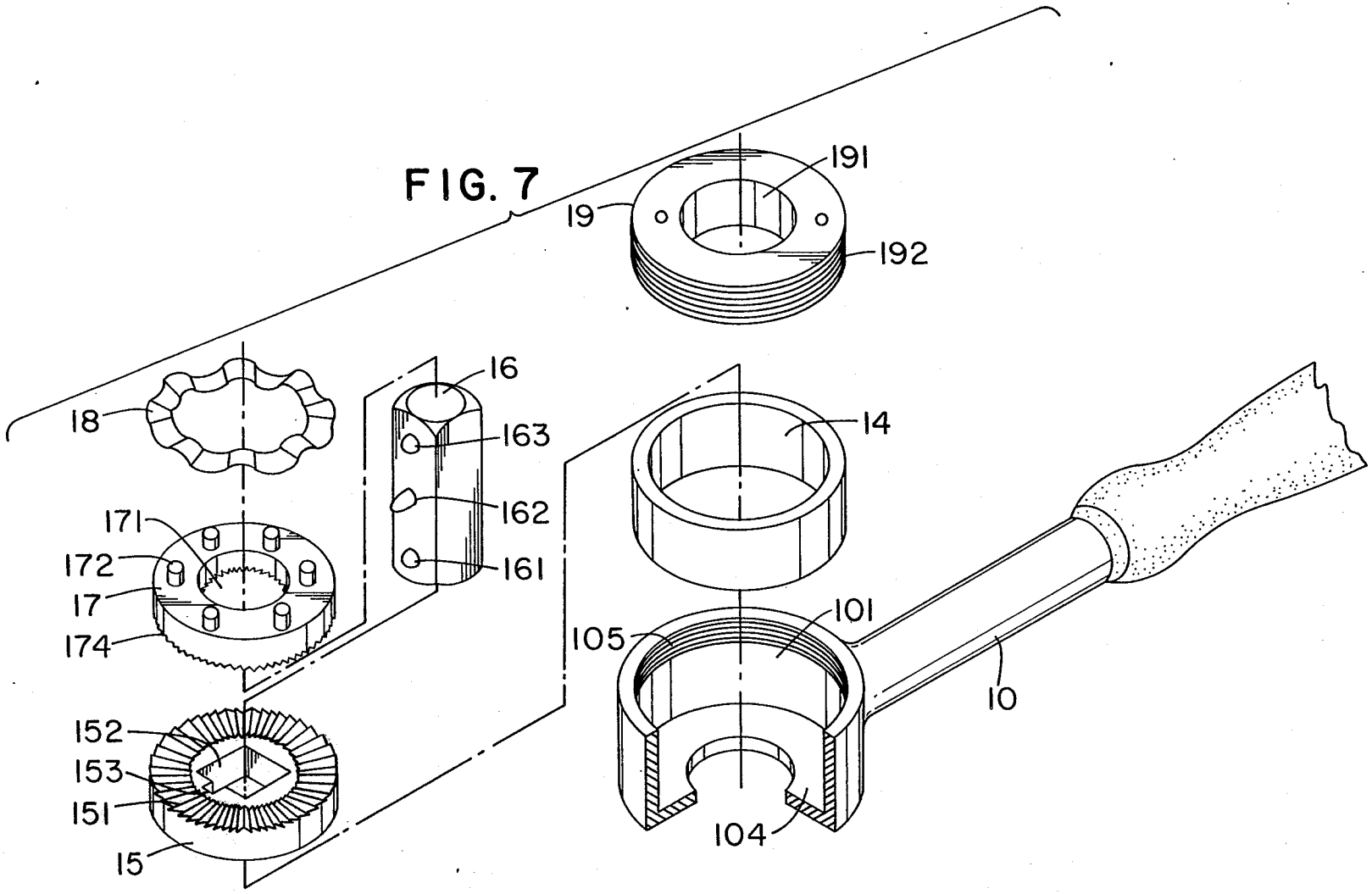
FIG. 7 is an exploded perspective view that illustrates the construction of a wrench according to a fourth embodiment of the present invention.

Another embodiment of the present invention is shown in FIGS. 7 and 8. The major differences between the wrench of this embodiment and the other embodiments are the coupling means for fixing the cover plate 19 on the opening of the driver housing 101 and for non-rotatably connecting the second gear face disc 17 to the wrench body. An additional jacket ring 14 which is radially bounded between the gear face discs and the driver housing 101 is used to prevent the cover plate 19 from over pressing the undulated spring washer 18, in which the jacket ring has a height slightly less than or equal to the total thickness of the meshed gear face discs and the underformed undulated spring washer 18.

Upright posts 172 located at the smooth side of the second gear face disc 17 are received in the corresponding bores located at the bottom surface of the cover plate 19 as it is screwed in the threaded bore 105 of the driver housing 101.

The thread 192 of the cover plate as well as the threaded bore 105 is preferably a left-handed thread.

It is preferable that the wrenches of the above embodiments further comprise an extra plug for sealing the void existing between the driving stud 16 and the cover plate 19.

Figure 9:
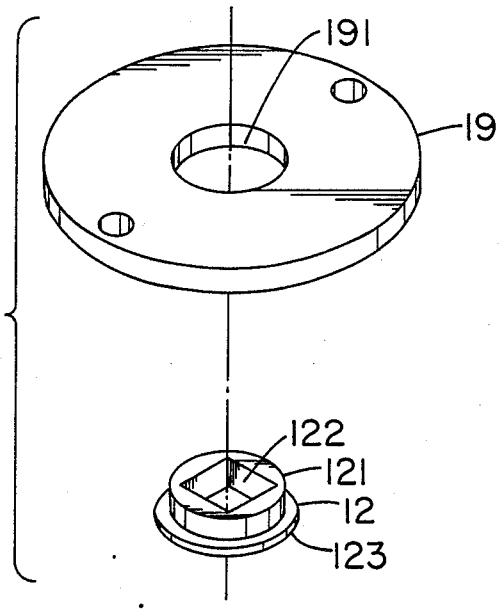
FIG. 9 is an exploded perspective view of that illustrates an extra plug 12 which is adapted to be mounted in the void existing between the driving stud 16 and the cover plate 19.
Figure 10:
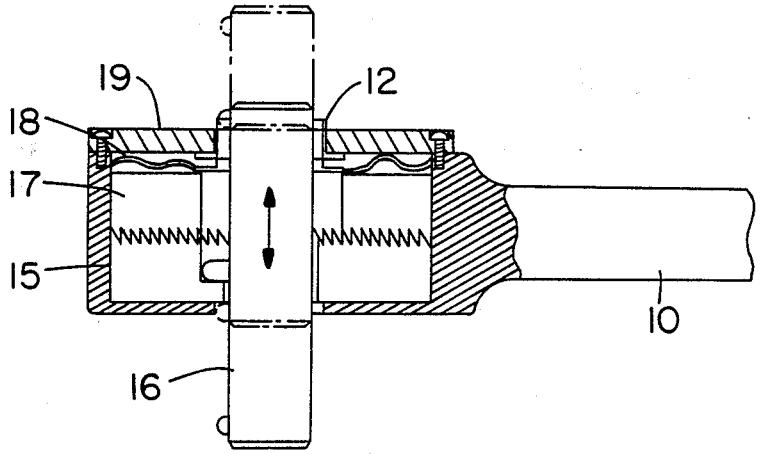
FIG. 10 is a longitudinal vertical section view that illustrates the construction of a wrench further comprising the extra plug 12 in FIG. 9.

With reference to FIGS. 9 and 10, an extra cylindrical plug 12 which has a square hole 122 corresponding to the square cross section of the driving stud 16 through its middle and an outward flange 123 having a diameter larger than the hole 171 at its lower end is placed on the smooth side of the second gear face disc 17 with its cylindrical portion 121 projecting into the hole 191 of the cover plate 19 and its flange 123 loosely bounded between the second gear face disc 17 and the cover plate 19. The remainder of the construction of the wrench is identical to that previously disclosed.

This extra plug 12 essentially results in the following improvements as it is mounted in the wrench constructed according to the present invention:

it enhances the stability of the in situ driving stud 16;

it prevents foreign matter from getting into the wrench by sealing the void between the driving stud 16 and the cover plate 19; and it prevents the inside mechanical parts from being exposed.

While the best mode for carrying out the invention has been described in detail, those familiar with the art to which this invention relates will recognize various alternative designs and embodiments for practising the invention as defined by the following claims.

I claim:

1. A reversible wrench comprising:

(a) A wrench body including a head and a handle extending therefrom, the head defining a driver housing having an opening perpendicular to the handle at one side;

(b) a first gear face disc having an extended middle portion defining a non-circular hole therethrough and including one side defined by a set of profile teeth and an opposite smooth side, the first disc being rotatably received in the housing;

(c) a second gear face disc having a hole through its central portion and a set of profile teeth on one side thereof, the second disc being disposed within the housing in concentric alignment with the first gear face disc, the sets of profile teeth of both disc adapted to be disposed in meshed engagement with each other;

(d) a spring means having a hole through its central portion and disposed with the housing for biasing the first and second discs in meshed engagement with each other;

(e) a cover plate having a hole through its central portion covering the opening of the housing and enclosing the spring means therein;

(f) a driving stud having a non-circular cross-section corresponding to that of the hole through the first disc, the stud being slidably mounted through the holes of the first and second discs, and the hole of the spring means, the stud having two ends for selective projection through either side of the driver head;

(g) means to non-rotatably connect the second gear face disc to the wrench body head comprising interengaging axial spline teeth formed on the second gear face disc and the wrench body head;

(h) attaching means to attach the cover plate to the extended middle portion of the first gear face disc;

(i) a pair of recesses defined by the extended middle portion, each of the recesses having a generally triangular cross-sectional configuration including an inclined wall and an end wall; and, (j) a retaining element generally centrally loacted on the driving stud and biased outwardly into contact with the extended middle portion and located so as to enter one of the recesses to limit the sliding of the driving stud relative to the extended middle portion.

2. The reversible wrench of claim 1 wherein the attaching means comprises: a groove defined by the extended middle portion; and, a snap ring insertable into the groove.

3. The reversible wrench of claim 1 wherein the spring means is disposed between the cover plate and second disc.

4. The reversible wrench of claim 1 wherein the spring means is an undulated spring washer.

5. The reversible wrench of claim 1 wherein the spring means is a compression spring.

6. The reversible wrench of claim 1 wherein the non-circular hole of the first disc and the cross-section of the driving stud are both of corresponding square configurations.

7. the reversible wrench of claim 6 wherein the driving stud is provided with two end retaining balls located at opposite ends thereof for selectively retaining sockets on either end of the stud.

* * * * *